US010464357B2

(12) United States Patent
Saiga

(10) Patent No.: US 10,464,357 B2
(45) Date of Patent: Nov. 5, 2019

(54) LIQUID DISCHARGE APPARATUS

(71) Applicant: Soichi Saiga, Tokyo (JP)

(72) Inventor: Soichi Saiga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 6 days.

(21) Appl. No.: 15/949,009

(22) Filed: Apr. 9, 2018

(65) Prior Publication Data

US 2018/0311983 A1 Nov. 1, 2018

(30) Foreign Application Priority Data

Apr. 26, 2017 (JP) ..... 2017-087018
Feb. 27, 2018 (JP) ..... 2018-033012

(51) Int. Cl.

| | |
|---|---|
| ***B41J 2/155*** | (2006.01) |
| ***B41J 25/308*** | (2006.01) |
| ***B41J 25/316*** | (2006.01) |
| ***B41J 25/00*** | (2006.01) |

(52) U.S. Cl.

CPC ..... *B41J 25/001* (2013.01); *B41J 2/155* (2013.01); *B41J 25/3082* (2013.01); *B41J 25/3086* (2013.01); *B41J 25/316* (2013.01)

(58) Field of Classification Search

CPC ..... B41J 25/001; B41J 25/3082; B41J 2/155; B41J 25/3086; B41J 25/316

See application file for complete search history.

(56) References Cited

U.S. PATENT DOCUMENTS 5,867,188 A * 2/1999 Murayama ..... B41J 25/34 347/37
2010/0231643 A1 9/2010 Saiga et al.
2011/0134187 A1 6/2011 Naruse et al.
2011/0205299 A1 8/2011 Naruse et al.
2012/0044310 A1* 2/2012 Yajima ..... B41J 2/1752 347/104
2012/0062649 A1 3/2012 Naruse et al.
2012/0320128 A1* 12/2012 Kumazaki ..... B41J 25/3082 347/37
2013/0093816 A1 4/2013 Mercadéet al.
2014/0063123 A1 3/2014 Saiga et al.
2016/0121634 A1 5/2016 Saiga et al.

FOREIGN PATENT DOCUMENTS

EP 2789464 A1 * 10/2014 ..... B41J 25/304
EP 2789464 A1 10/2014
JP 2016-087873 5/2016

OTHER PUBLICATIONS

European Search Report; Application 18163747.1-1019; dated Oct. 1, 2018.

* cited by examiner

*Primary Examiner* — Jason S Uhlenhake

(74) *Attorney, Agent, or Firm* — Duft & Bornsen, PC

(57) ABSTRACT

A liquid discharge apparatus includes a liquid discharge head to discharge liquid, a head holder to hold the liquid discharge head, a sub-carriage to hold the head holder, and a carriage to hold the sub-carriage and which is movable in a main scanning direction. The carriage includes a reference extending along the main scanning direction that holds and positions the sub-carriage in the carriage. The head holder includes a rotation reference around which the head holder is rotatable with respect to the sub-carriage, and an angle adjuster to regulate a rotation and adjust an angle of the rotation of the head holder with respect to the sub-carriage.

8 Claims, 9 Drawing Sheets

LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2017-087018, filed on Apr. 26, 2017, and Japanese Patent Application No. 2018-033012, filed on Feb. 27, 2018, in the Japan Patent Office, the entire disclosure of each of which is hereby incorporated by reference herein.

BACKGROUND

Technical Field

Aspects of the present disclosure relate to a liquid discharge apparatus.

Related Art

As an image forming apparatus such as a printer, a facsimile machine, a photocopier, a plotter, or a multifunction peripheral (serving as any combination of a printer, a facsimile machine, and a photocopier), for example, an image forming apparatus employing a liquid discharge recording system (inkjet recording apparatus, for example) is known. The image forming apparatus employing the liquid discharge recording system includes a liquid discharge head as a recording head to discharge liquid droplets such as ink.

SUMMARY

In an aspect of this disclosure, a liquid discharge apparatus includes a liquid discharge head to discharge liquid, a head holder to hold the liquid discharge head, a sub-carriage to hold the head holder, and a carriage to hold the sub-carriage and movable in a main scanning direction. The carriage includes a reference extending along the main scanning direction that holds and positions the sub-carriage in the carriage. The head holder includes a rotation reference around which the head holder is rotatable with respect to the sub-carriage, and an angle adjuster to regulate a rotation and adjust an angle of the rotation of the head holder with respect to the sub-carriage.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
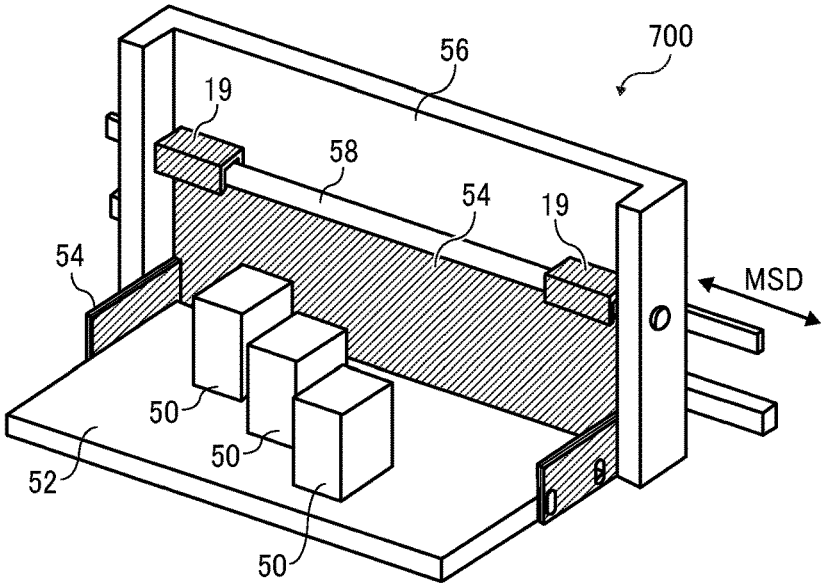
FIG. 1 is a schematic perspective view of an example of a carriage of a liquid discharge apparatus.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Hereinafter, embodiments of the present disclosure are described with reference to the attached drawings. First, a liquid discharge head according to a comparative example is described with reference to FIGS. 1 and 2. In the following, the liquid discharge head is simply referred to as "head".

Figure 2:
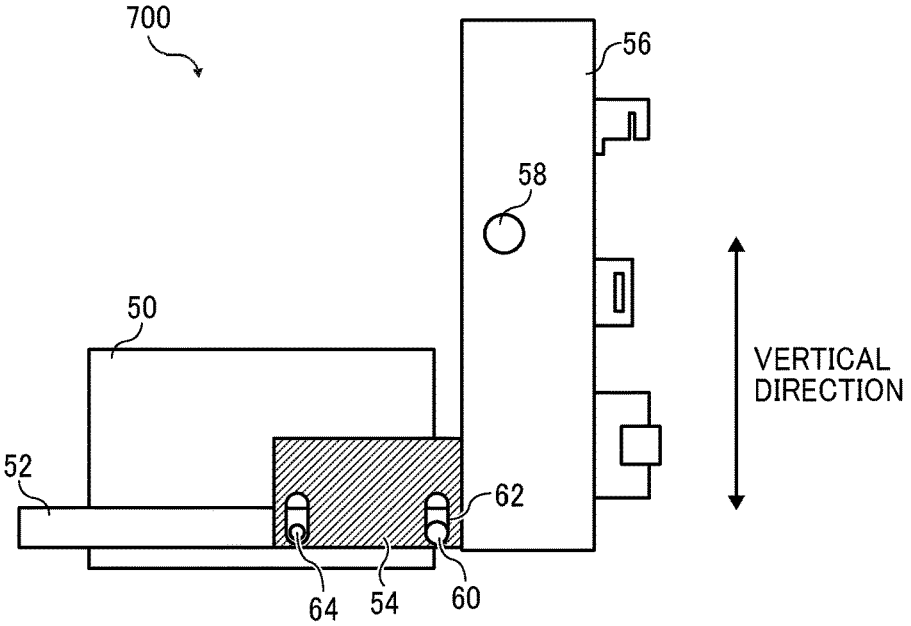
FIG. 2 is a schematic side view of the example of the carriage of the liquid discharge apparatus.

FIGS. 1 and 2 illustrate a carriage 56 of a liquid discharge apparatus 700 according to a comparative example. FIG. 1 is a schematic perspective view illustrating the carriage of the liquid discharge apparatus according to the comparative example. FIG. 2 is a side view of the carriage of FIG. 1.

The liquid discharge apparatus 700 includes a head holder 52 and a platen. As illustrated in FIG. 1, the head holder 52 holds the heads 50. The platen holds a sheet as a recording medium onto which the liquid is discharged from the heads 50. The head holder 52 can adjust tilt of the head holder 52 on the actual machine. The tilt is a parallelism between the head holder 52 and the platen.

As illustrated in FIG. 1, the liquid discharge apparatus 700 includes the heads 50, the head holder 52, a sub-carriage 54, and a carriage 56. The head 50 includes a plurality of nozzles for discharge liquid droplets. The head holder 52 holds the heads 50. The sub-carriage 54 holds the head holder 52. The carriage 56 holds the sub-carriage 54 and is movable in a main scanning direction.

A reference shaft 58 extending along a main scanning direction is provided on the carriage 56. The sub-carriage 54 is supported by the reference shaft 58 and positioned on the carriage 56. The main scanning direction is indicated by arrow "MSD" in FIG. 1. As illustrated in FIG. 2, the head holder 52 and the sub-carriage 54 includes a rotation shaft 60 of the head holder 52, a slot 62, and a fastener 64. The rotation shaft 60 is supported within the slot 62 so that the rotation shaft 60 is rotatable and also movable in a vertical direction. The fastener 64 fixes the head holder 52 to the sub-carriage 54. Thus, the head holder 52 is rotatable around the rotation shaft 60. Further, as described above, an inclination of the head holder 52 on the actual machine can be adjusted. In addition, the vertical position of a nozzle surface 6*f* of the head 50 can also be adjusted by adjusting the inclination of the head holder 52.

In this liquid discharge apparatus 700, it is necessary to fix the head holder 52 to the sub-carriage 54 with the fastener 64 in a state where the head holder 52 is held by the sub-carriage 54 at a target inclination (parallelism). Thus, there is a problem that an attitude of the head holder 52 should be maintained by using a jig. Further, an operation of maintaining the attitude of the head holder 52 is difficult.

Following embodiments describe the liquid discharge apparatus 70 capable of easily and highly accurately adjusting the tilt of the head holder 52 on the actual machine.

[First Embodiment]

Figure 3:
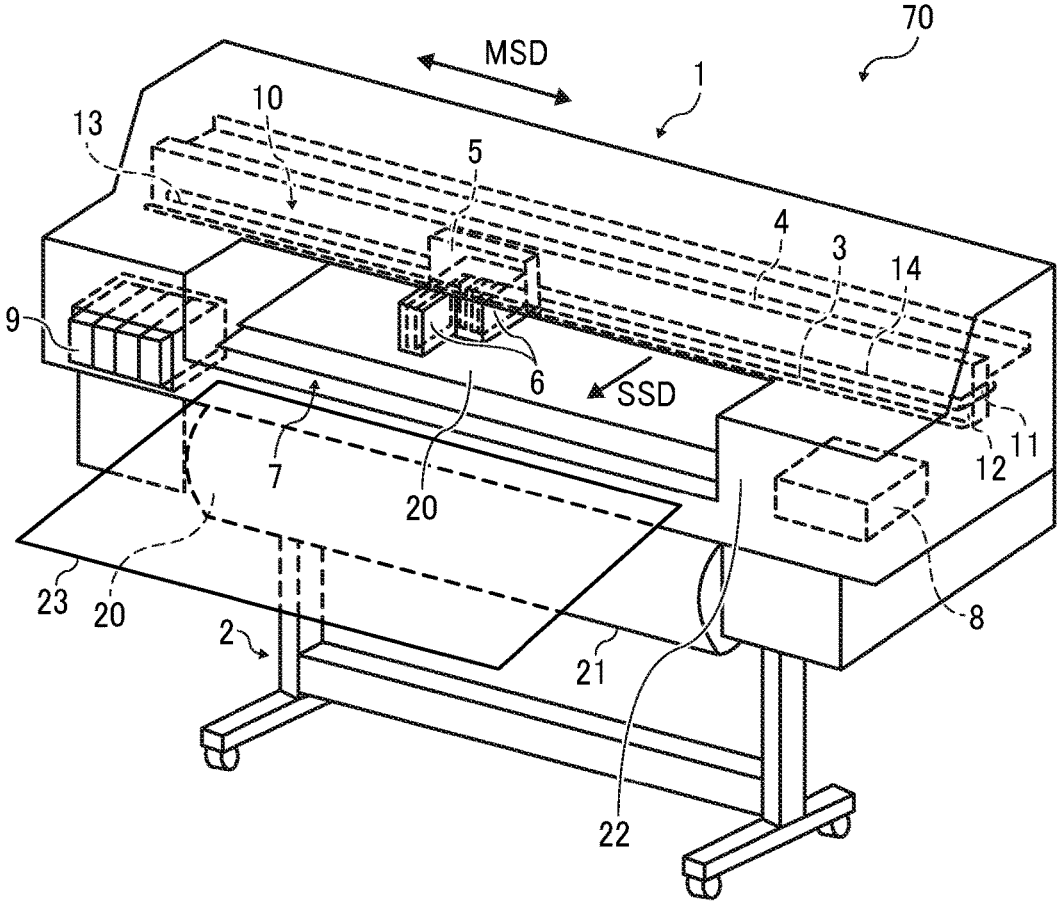
FIG. 3 is a perspective view of a liquid discharge apparatus according to a first embodiment of the present disclosure.
Figure 4:
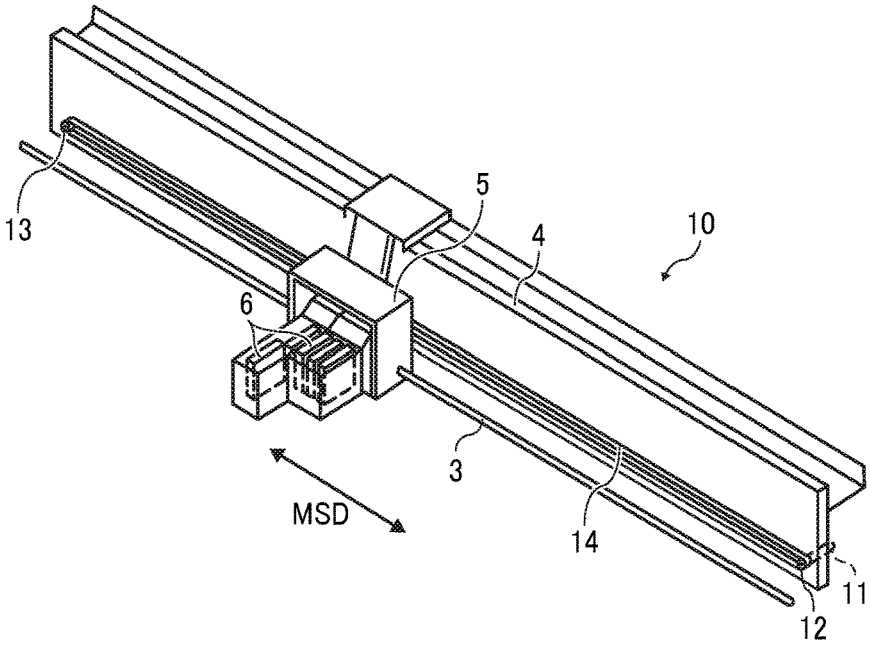
FIG. 4 is a perspective view of a carriage scanner in FIG. 3.

FIG. 3 is a schematic perspective view illustrating an entire configuration of the liquid discharge apparatus 70 according to a first embodiment of the present disclosure. FIG. 4 is a perspective view of a carriage scanner 10 according to the first embodiment of the present disclosure.

As illustrated in FIG. 3, this liquid discharge apparatus 70 is a serial type inkjet recording apparatus, and includes an apparatus body 1 and a support base 2 for supporting the apparatus body 1. The guide rod 3 and the guide stay 4 spans between side plates in the apparatus body 1. The guide rod 3 and the guide stay 4 serve as a guide member. A carriage 5 is supported by the guide rod 3 and the guide stay 4 so that the carriage 5 is movable in the main scanning direction indicated by arrow MSD.

The carriage 5 mounts the heads 6 that discharge ink droplets of each of the colors black (K), yellow (Y), magenta (M), and cyan (C). Each head 6 includes multiple nozzles to discharge the liquid droplets. Each head 6 integrally includes a head tank for supplying ink to the corresponding head 6.

The carriage scanner 10 moves and scans the carriage 5 in the main scanning direction MSD. The carriage scanner 10 includes a drive motor 11, a drive pulley 12, a driven pulley 13, and a timing belt 14. The drive motor 11 is disposed on one side of the apparatus body 1 in the main scanning direction MSD. The drive pulley 12 is rotary-driven by the drive motor 11. The driven pulley 13 is disposed on another side of the apparatus body 1 in the main scanning direction MSD. The timing belt 14 is a towing member stretched between the drive pulley 12 and the driven pulley 13. The driven pulley 13 is pulled by a tension spring in a direction away from the drive pulley 12.

A sheet 20 is intermittently conveyed by a suction conveyor 22 in a direction indicated by arrow SSD (sub-scanning direction, or sheet conveyance direction) perpendicular to the main scanning direction MSD of the carriage 5 in a recording area of a main scanning area of the carriage 5.

In one of an end side area of the main scanning area of the apparatus body 1, a suction device 8 is disposed to suck the liquid from the heads 6 to maintain a discharge property the heads 6. Further, main cartridges 9 are detachably mounted on the apparatus body 1 on an area outside the carriage moving area in the main scanning direction MSD or on another end side area of the main scanning area. The main cartridges 9 store respective colors of inks to be supplied to the sub tanks of the heads 6. Further, a roll sheet (hereinafter referred to as "sheet 20") is set in a feeder 21. The sheet 20 having different sizes in a width direction may also be set on the feeder 21.

In the liquid discharge apparatus configured as described above, image formation is performed as follows. First, the sheet 20 conveyed from the feeder 21 is conveyed to the recording area by the suction conveyor 22 from a rear side to a front side of the apparatus body 1 in the sub-scanning direction SSD.

Next, a required image is formed on the sheet 20 by discharging liquid droplets by the heads 6 driven according to image information while the carriage 5 is moved in the main scanning direction MSD and the sheet 20 is intermittently fed to the platen 7 by the suction conveyor 22. The sheet 20 after image formation is cut to a predetermined length and ejected to a discharge tray 23 disposed on the front side of the apparatus body 1.

Although the configuration in which the sheet 20 is cut and ejected is described here, it is also possible to adopt a configuration in which the sheet after image formation is wound by an ejector without cutting.

Next, a configuration of the carriage 5 of the liquid discharge apparatus 70 is described in detail below.

Figure 5:
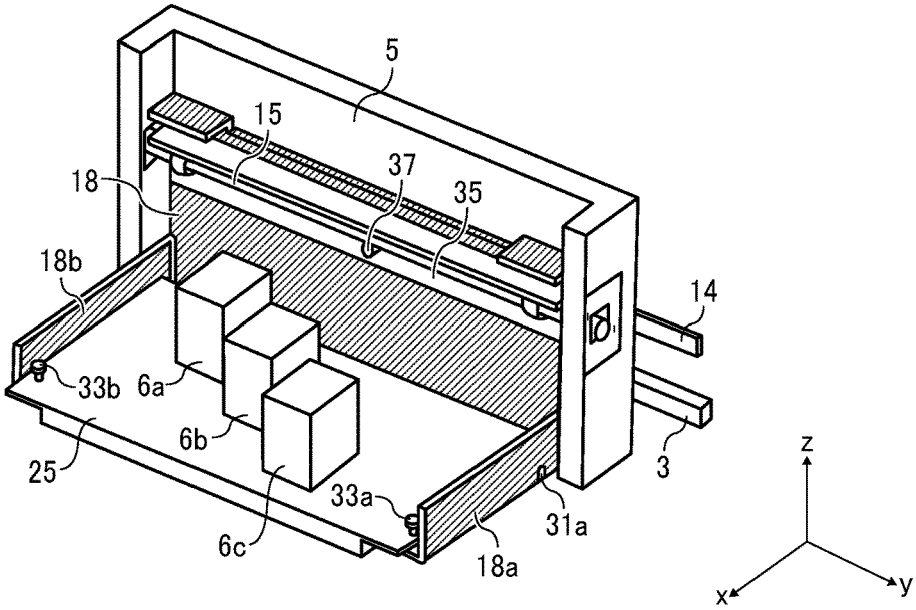
FIG. 5 is a schematic perspective of the carriage according to the first embodiment of the present disclosure.

FIG. 5 is a schematic perspective of the carriage 5 of according to the first embodiment of the present disclosure. As illustrated in FIG. 5, the carriage 5 holds the head holder 25 via the sub-carriage 18. Here, to make the directions easy to understand, an XYZ Cartesian coordinate system is used below. In FIG. 5, an X-direction (X-axis) indicates the sub-scanning direction SSD and a Y-direction (Y-axis) indicates the main scanning direction MSD.

Further, the head holder 25 mounts the heads 6*a*, 6*b*, and 6*c* arranged in a staggered manner in the X direction (sub-scanning direction). When the heads 6*a*, 6*b*, and 6*c* are not distinguished individually, they are collectively referred to as "heads 6". Further, although the number of heads 6 mounted on the head holder 25 is at least one, for example, these may be one, two, or more than three.

The carriage 5 includes a reference shaft 15 serving as a "reference" extending in the same direction (main scanning direction, Y-direction) as a guide rod 3. The guide rod 3 is extending in the Y-direction (main scanning direction, MSD). The sub-carriage 18 is detachably and rotatably hung on the reference shaft 15 via an adjustment member 35. Further, the sub-carriage 18 contacts the carriage 5 in a rotation direction of the sub-carriage 18 and is held (positioned) by the carriage 5.

Figure 6:
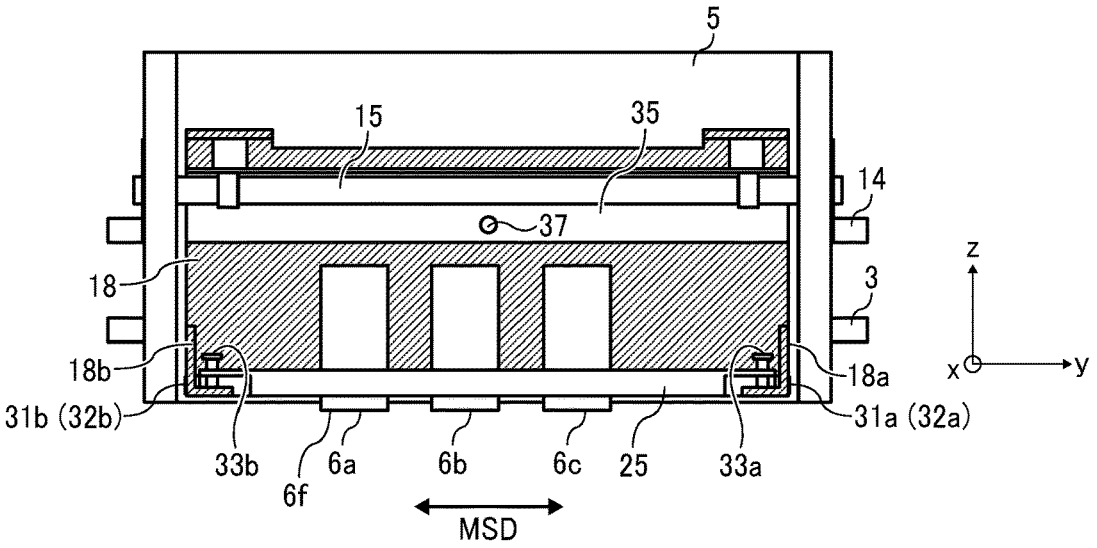
FIG. 6 is a schematic front view of the carriage according to the first embodiment of the present disclosure.

FIG. 6 is a schematic front view of the carriage 5 according to the first embodiment of the present disclosure. As illustrated in FIG. 6, the adjustment member 35 is rotatably supported on the sub-carriage 18 around the sub-carriage rotation reference 37. That is, the adjustment member 35 is rotatable around the X-axis (X-direction, sub-scanning direction SSD). The sub-carriage rotation reference 37 has a shape of a pin and is configured to fix the adjustment member 35 by inserting the sub-carriage rotation reference 37 into the sub-carriage 18. Alternatively, the sub-carriage rotation reference 37 may be configured to be fastened into the sub-carriage 18 as a step screw.

Figure 7:
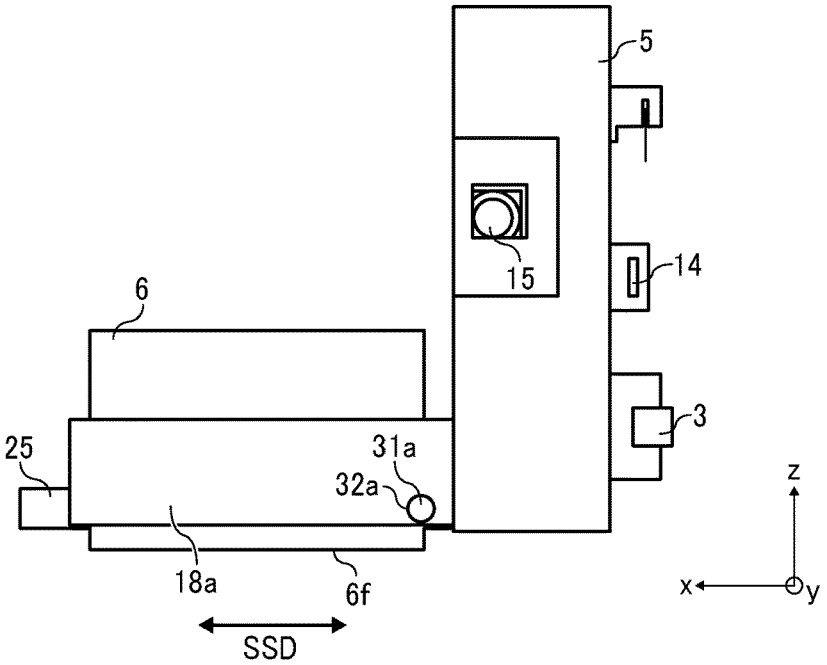
FIG. 7 is a schematic side view of the carriage according to the first embodiment of the present disclosure.

The sub-carriage 18 includes holders 18*a*and 18*b* disposed at both ends of the head holder 25 in the Y-direction (main scanning direction MSD). The sub-carriage 18 holds the head holder 25 with the holders 18*a* and 18*b*. Each of the holders 18*a* and 18*b* are extending along the X-direction (sub-scanning direction SSD) as illustrated in FIG. 7. Thus, the sub-carriage 18 is detachably and rotatably hooked on the reference shaft 15 via the adjustment member 35. Since the sub-carriage 18 holds the head holder 25, the head holder 25 is also held to be rotatable around the axis of the reference shaft 15.

Thus, providing the reference shaft 15 in the same direction (parallel) with the guide rod 3 of the carriage 5 can improve an accuracy of a position of the heads 6 in the sub-scanning direction SSD (X-direction), a height direction (Z-direction), a tilt direction, and the main scanning direction MSD (Y-direction) of the heads 6.

Further, the sub-carriage 18 is supported by the carriage 5 to be inclined with respect to the reference shaft 15 by rotating the adjustment member 35 around the sub-carriage rotation reference 37. Thus, parallelism between the head 6 and the platen 7 in the X-direction (sub-scanning direction) can be adjusted.

FIG. 7 is a schematic side view of the carriage 5 according to the first embodiment of the present disclosure. As illustrated in FIGS. 5 to 7, the head holder 25 includes rotation reference 31*a* and 31*b* at both ends of the head holder 25 in a Y-direction (main scanning direction MSD). The holders 18*a*and 18*b* extending along both ends of the head holder 25 includes shaft holes 32*a* and 32*b* that rotatably support the rotation reference 31*a* and 31*b*. Further, the head holder 25 includes adjustment screws 33*a* and 33*b* at both ends of the head holder 25 in the Y-direction (main scanning direction MSD). The adjustment screws 33*a* and 33*b* serve as angle adjusters that regulate a rotation of the head holder 25 with respect to the sub-carriage 18 and adjust a rotation angle of the head holder 25. The sub-carriage 18 may include the rotation reference 31*a* and 31*b*, and the head holder 25 may include the shaft holes 32*a* and 32*b*.

Thus, the head holder 25 includes a rotation reference 31*a* and 31*b* around which the head holder 25 is rotatable with respect to the sub-carriage 18, and the angle adjusters (adjustment screws 33*a* and 33*b*) regulate a rotation and adjust an angle of the rotation of the head holder 25 with respect to the sub-carriage 18.

Figure 8:
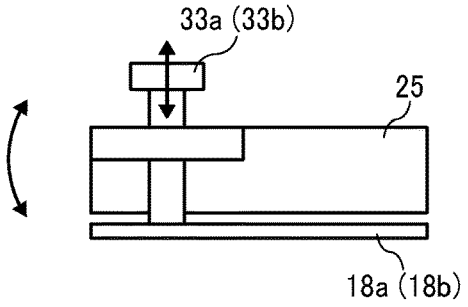
FIG. 8 is an enlarged side view of an adjustment screw portion.

FIG. 8 is an enlarged view of the head holder 25. Screw threads of adjustment screws 33*a* and 33*b* are rotatably supported by the head holder 25, for example. Further, tips of the adjustment screws 33*a* and 33*b* are rotatably supported by the holders 18*a*and 18*b* of the sub-carriage 18. Thus, the adjustment screws 33*a* and 33*b* regulate the rotation (around the Y-axis, (Y-direction, main scanning direction MSD) of the head holder 25 with respect to the sub-carriage 18. Further, an interval between the sub-carriage 18 and the head holder 25 can be changed by screwing the adjustment screws 33*a* and 33*b*.

Figure 9A:
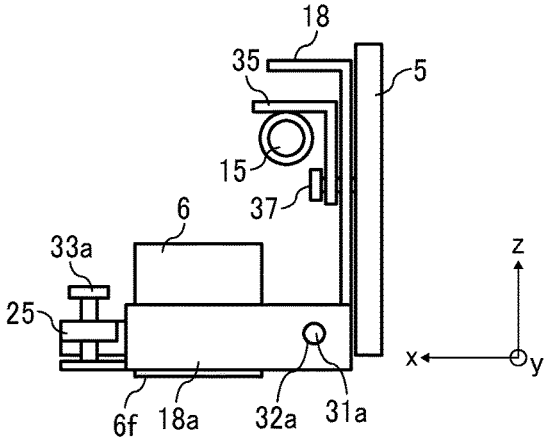
FIGS. 9A and 9B are schematic side views of the carriage according to a first embodiment of the present disclosure
Figure 9B:
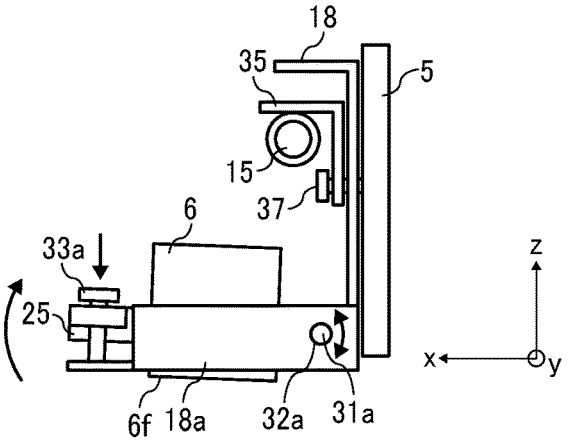

FIGS. 9A and 9B are schematic side views of the carriage 5 according to a first embodiment of the present disclosure FIG. 9A illustrates the carriage 5 before adjustment process. FIG. 9B illustrates the carriage 5 after the adjustment process. For the sake of simplicity, some of the members of the carriage 5 is omitted.

As illustrated in FIGS. 9A and 9B, the rotation angle of the head holder 25 in the Z-direction (height direction) with respect to the sub-carriage 18 can be adjusted by how far the adjustment screws 33*a* and 33*b* are screwed into the holes. Thus, the parallelism between the nozzle surface 6*f* of the head 6 and the platen 7 in the Y-direction (main scanning direction) can be adjusted. The parallelism can be further finely adjusted by reducing the pitch of the adjustment screws 33*a* and 33*b*. Thus, the parallelism between the nozzle surface 6*f* of the head 6 and the platen 7 can be further finely adjusted.

Further, as illustrated in FIGS. 5 and 6, how far the adjustment screws 33*a* and 33*b* are screwed into the holes can be changed in both the left and right side of the head holder 25 since the adjustment screws 33*a* and 33*b* are provided on each of the left and right sides of the head holder 25. Thus, the carriage 5 according to the present embodiment can adjust the parallelism between the nozzle surface 6*f* of the heads 6 and the platen 7 including a twist of the head holder 25 and a distortion of the sub-carriage 18.

Furthermore, the rotation of the head holder 25 around the rotation reference 31*a* and 31*b* is regulated by the adjustment screws 33*a* and 33*b*. Thus, the carriage 5 can prevent accidents such that the head holder 25 rotates largely and the nozzle surface 6*f* of the heads 6 comes into contact with the platen 7. Therefore, it is not necessary to use a jig or the like to adjust the position of the head holder 25. Further, the position of the head holder 25 can easily be adjusted while measuring and checking the position of the head holder 25 on the actual machine.

The sub-carriage 18 is supported by the reference shaft 15 via the adjustment member 35. The adjustment member 35 is supported by the carriage 5 and is rotatable around the X-axis (X-direction, sub-scanning direction SSD) perpendicular to the Y-axis (Y-direction, main scanning direction MSD), and a tilt of sub-carriage 18 is adjustable with respect to the reference shaft 15 by a rotation of the adjustment member 35 around the X-axis (X-direction, sub-scanning direction SSD).

In FIGS. 5 to 7, the rotation references 31*a* and 31*b* are provided on the head holder 25, and the shaft holes 32*a* and 32*b* are provided in the sub-carriage 18. However, the present disclosure is not limited to the embodiment as illustrated in FIGS. 5 to 7. Alternatively, a shaft hole may be provided in the head holder 25, and a rotation reference may be provided in the sub-carriage 18. Further, the rotation references 31*a* and 31*b* may have a configuration in which a pin-shaped rotation reference is inserted, or a configuration in which a step screw is tightened.

Further, fixing means for fixing the sub-carriage 18 and the adjustment member 35 may be provided on the carriage 5. Further, fixing means for fixing the sub-carriage 18 and the head holder 25 may be provided on the carriage 5.

Figure 10:
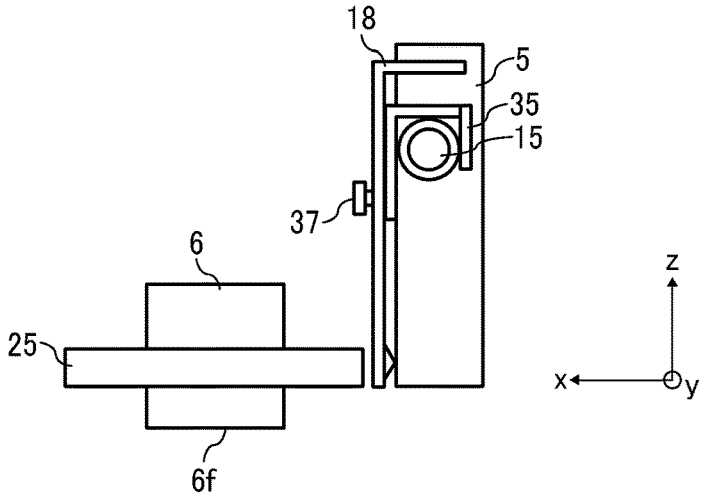
FIG. 10 is a schematic side view of the carriage according to the first embodiment of the present disclosure.

Furthermore, in FIGS. 5 and 6, the sub-carriage 18 is sandwiched and held between the reference shaft 15 and the carriage 5. However, the configuration of the sub-carriage 18 is not limited to FIGS. 5 and 6. Alternatively, as illustrated in FIG. 10, the sub-carriage 18 may be hooked and held on the reference shaft 15 from the front side of the carriage 5. Further, the sub-carriage 18 may be held on the reference shaft 15 without using the adjustment member 35.

Next, a second embodiment of the carriage 5 according to the present disclosure is described below.

Figure 11:
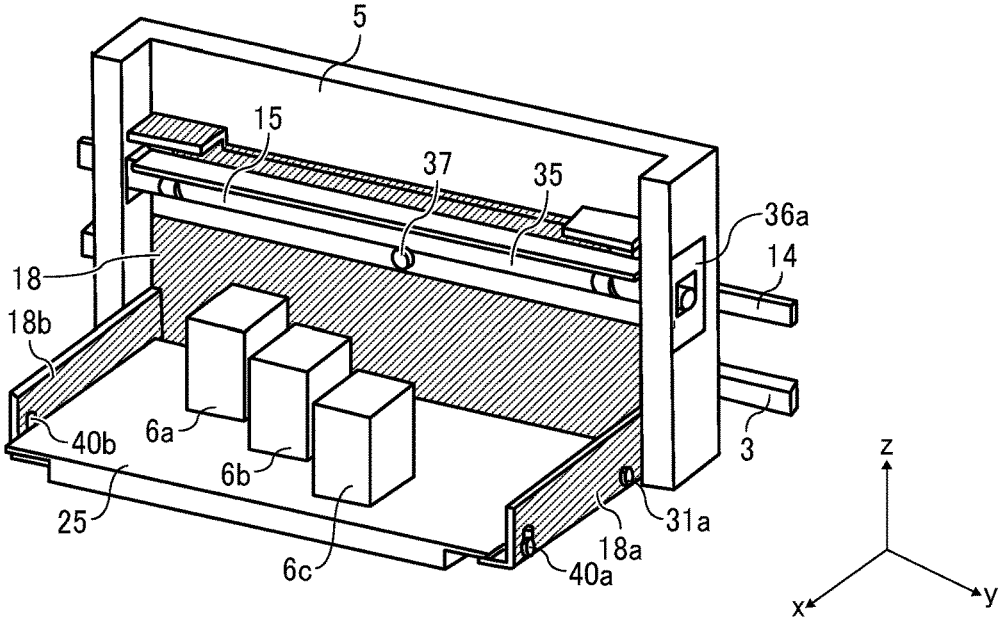
FIG. 11 is a schematic perspective of the carriage according to a second embodiment of the present disclosure.
Figure 12:
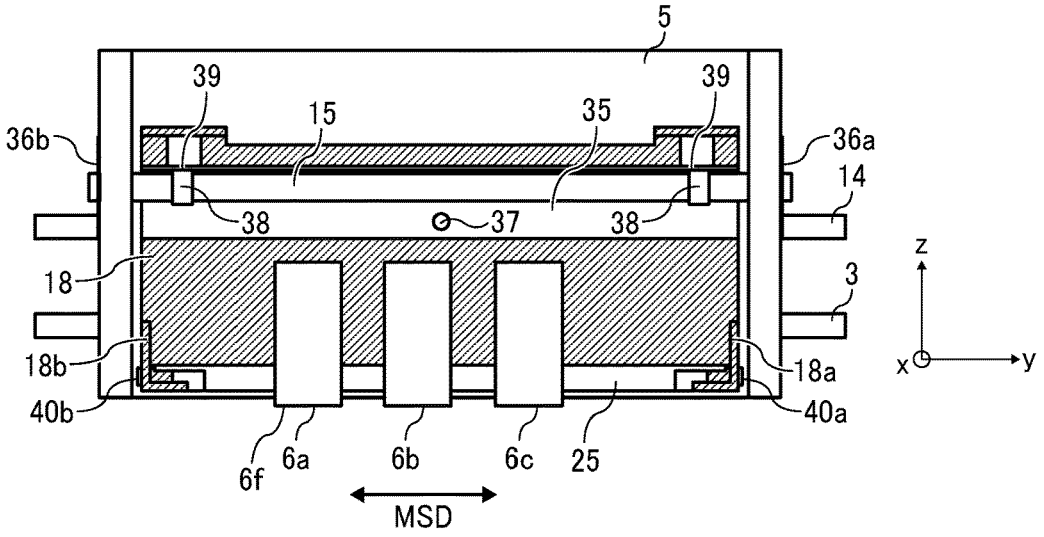
FIG. 12 is a schematic front view of the carriage according to the second embodiment of the present disclosure.

FIG. 11 is a schematic perspective of the carriage 5 of according to the second embodiment of the present disclosure. FIG. 12 is a schematic front view of the carriage 5 according to the second embodiment of the present disclosure. Identical reference numerals are assigned to components illustrated in FIGS. 11 and 12 that are identical to the components illustrated in FIGS. 5 and 6 and description of the identical components is omitted.

As illustrated in FIGS. 11 and 12, adjustment cams 40*a* and 40*b* may be provided as the angle adjusters. The adjustment cams 40*a* and 40*b* are advantageous because an adjustment resolution can be improved compared with the adjustment screws 33*a* and 33*b* in the first embodiment.

Figure 13A:
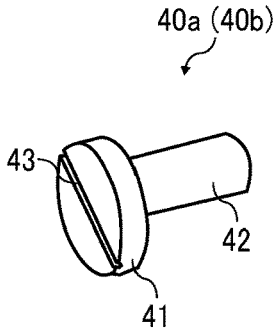
FIGS. 13A and 13B are perspective views of adjustment cams.
Figure 13B:
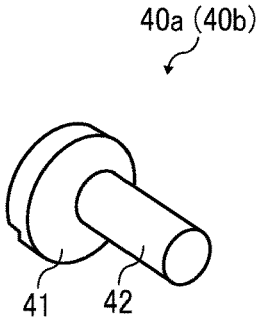
Figure 14A:
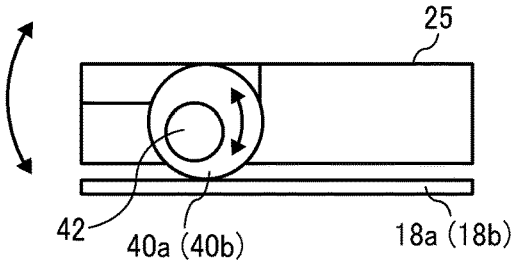
FIGS. 14A and 14B are enlarged views of a part of the carriage related to the adjustment cams.
Figure 14B:
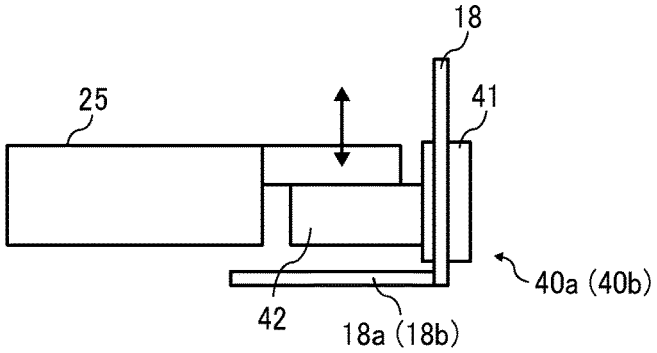

FIGS. 13A and 13B are perspective views of the adjustment cams 40*a* and 40*b*. FIGS. 14A and 14B are enlarged views of a part of the carriage 5 related to the adjustment cams 40*a* and 40*b*. As illustrated in FIGS. 13A and 13B, the adjustment cams 40*a* and 40*b* includes a cam portion 41 and a shaft 42 attached eccentrically to the cam portion 41. Further, the cam portion 41 includes a minus groove 43 for screwing. As illustrated in FIGS. 14A and 14B, the cam portions 41 of the adjustment cams 40*a* and 40*b* are rotatably attached to the holders 18*a*and 18*b* of the sub-carriage 18. The head holder 25 can be lifted or lowered by rotating the cam portion 41 of the adjustment cams 40*a* and 40*b* around the shaft 42. Thus, the rotation angle of the head holder 25 with respect to the sub-carriage 18 can be adjusted.

Figure 15A:
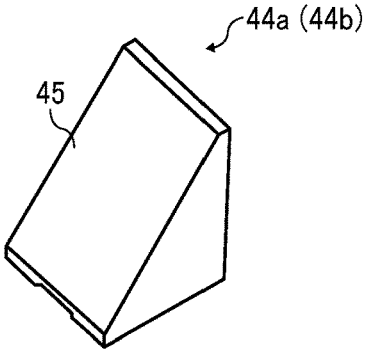
FIGS. 15A and 15B are perspective views of adjustment wedges.
Figure 15B:
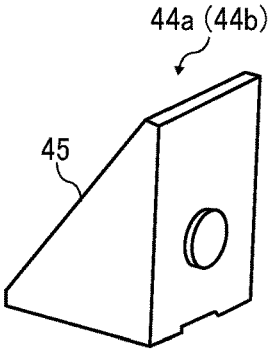
Figure 16A:
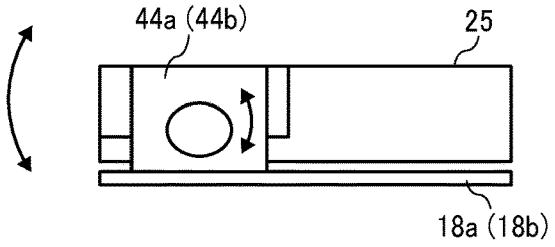
FIGS. 16A and 16B are enlarged side view and front view of a part of the carriage related to the adjustment wedges, respectively.
Figure 16B:
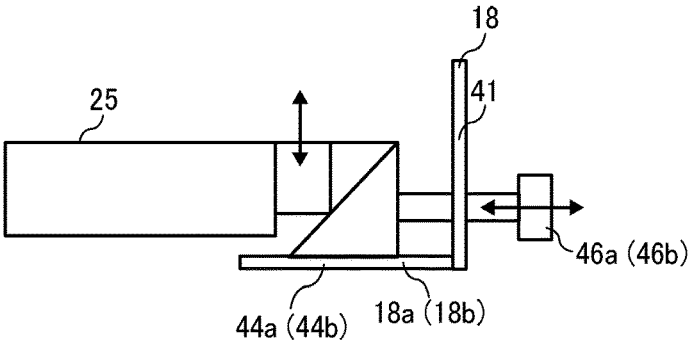

Further, adjustment wedges 44*a* and 44*b* may be used as the angle adjuster. FIGS. 15A and 15B are perspective views of the adjustment wedges 44*a* and 44*b*. FIG. 16A is an enlarged side view of a part of the carriage 5 related to the adjustment wedges 44*a* and 44*b*. FIG. 16B is an enlarged front view of a part of the carriage 5 related to the adjustment wedges 44*a* and 44*b*. As illustrated in FIGS. 15A and 15B, each of the adjustment wedges 44*a* and 44*b* has a sloped surface 45. As illustrated in FIGS. 16A and 16B, the rotation angle of the head holder 25 with respect to the sub-carriage 18 can be adjusted by rotating screws 46*a* and 46*b* attached to the holders 18*a*and 18*b* of the sub-carriage 18 and pushing the adjustment wedges 44*a* and 44*b* to the head holder 25.

The angle adjuster is not limited to the adjustment screws 33*a* and 33*b*, and the adjustment cams 40*a* and 40*b* as described above may be used as the angle adjuster, for example. Any means can be used as the angle adjuster as long as it can regulate the rotation of the head holder 25 with respect to the sub-carriage 18 and can adjust the rotation angle. For example, a piezoelectric actuator or the like can also be used as the angle adjuster.

Further, the reference shaft 15 may be fixed to the carriage 5 via adjustment plates 36*a* and 36*b*. The adjustment plates 36*a* and 36*b* can adjust the position of the reference shaft 15 with respect to the carriage 5. Adjusting the position of the reference shaft 15 can adjust a posture (height direction, rotation direction, and tilt in the main scanning direction) of the head holder 25. Thus, the reference shaft 15 can improve a mounting position of the head 6 to the head holder 25.

Figure 17:
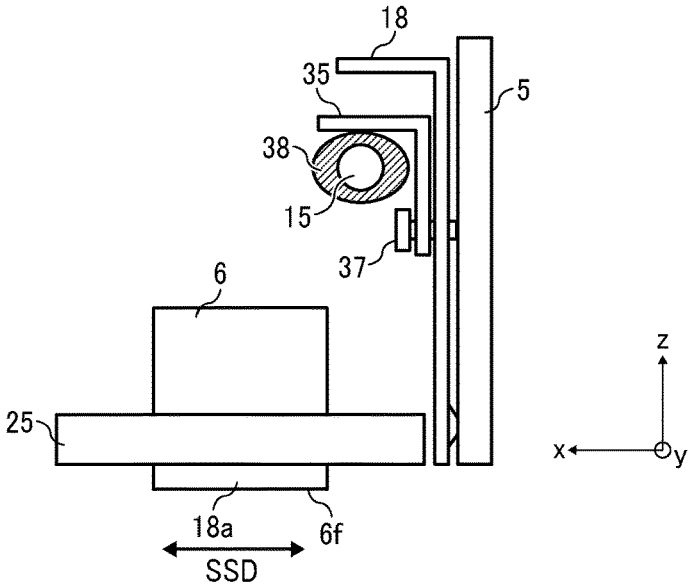
FIG. 17 is a schematic side view of the carriage according to a third embodiment of the present disclosure.

FIG. 17 is a schematic side view of the carriage according to a third embodiment of the present disclosure. As illustrated in FIG. 12 as a front view and in FIG. 17 as a side view, a cam 38 may be provided on the reference shaft 15. The cam 38 is brought into contact with the adjustment member 35 at a contacting surface 39, and positions the vertical direction of the sub-carriage 18. The sub-carriage 18 can be raised and lowered by rotating the cam 38. Thus, the distance between the heads 6 and the platen 7 can be changed. Therefore, the height of the heads 6 can be adjusted according to a thickness of the sheet 20, for example.

As a method of rotating the cam 38, the cam 38 may be fixed to the reference shaft 15 and may rotate by rotating the reference shaft 15. The means for rotating the reference shaft 15 may include manually operating the reference shaft 15 or disposing a drive source that automatically rotates the reference shaft 15 to raise and lower the heads 6. This method enables an operation of raising and lowering the heads 6 of the carriage 5 from the outside.

The distance between the heads 6 and the platen 7 can be arbitrarily adjusted in the actual machine according to the printing media by raising and lowering the heads 6 by the cam 38. Thus, the present disclosure can expand the types of print media that can be handled.

Next, terms used in the present embodiment are defined below.

The term "liquid discharge apparatus" used herein is an apparatus including the liquid discharge head or the liquid discharge device to discharge liquid by driving the liquid discharge head. The liquid discharge apparatus may be, for example, an apparatus capable of discharging liquid to a material to which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a solid fabrication apparatus (three-dimensional fabricating apparatus) to discharge a fabrication liquid to a powder layer in which powder material is formed in layers, to form a solid fabrication object (three-dimensional fabrication object).

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell. The "medium on which liquid can be adhered" includes any medium on which liquid is adhered, unless particularly limited.

Examples of the material on which liquid can be adhered include any materials on which liquid can be adhered even temporarily, such as paper, thread, fiber, fabric, leather, metal, plastic, glass, wood, ceramic, construction materials (e.g., wall paper or floor material), and cloth textile.

Further, the term "liquid" includes any liquid having a viscosity or a surface tension that can be discharged from the head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant.

Such a solution, a suspension, or an emulsion can be, e.g., inkjet ink, surface treatment solution, a liquid for forming components of electronic element or light-emitting element or a resist pattern of electronic circuit, or a material solution for three-dimensional fabrication.

"The liquid discharge apparatus" may be an apparatus to relatively move a head and a medium on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet surface to coat the sheet surface with the treatment liquid to reform the sheet surface and an injection granulation apparatus to discharge a composition liquid including a raw material dispersed in a solution from a nozzle to mold particles of the raw material.

The "liquid discharge device" is an integrated unit including the liquid discharge head and a functional parts or mechanisms, and is an assembly of parts relating to liquid discharge. For example, "the liquid discharge device" may be a combination of the head with at least one of a head tank, a carriage, a supply unit, a maintenance unit, and a main scanner.

Herein, the terms "integrated" or "united" mean fixing the head and the functional parts (or mechanism) to each other by fastening, screwing, binding, or engaging and holding one of the head and the functional parts movably relative to the other. The liquid discharge head may be detachably attached to the functional parts or mechanisms each other.

The main scanner may be a guide only. The supply unit may be a tube(s) only or a mount part (loading unit) only.

The term "liquid discharge head" used herein is a functional component to discharge or jet liquid from nozzles. Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

In the present embodiment, "sheet" is not limited to paper materially, but includes transparent sheets, cloth, glass, substrates, others to which ink droplets and other liquid can be attached, and articles referred to as a recording medium, a recording sheet, recording paper, etc. The terms "image formation", "recording", "printing", and "image printing" used herein may be used synonymously with each another.

The term "ink" is not limited to "ink" in a narrow sense, unless specified, but is used as a generic term for any types of liquid usable as targets of image formation such as recording liquid, fixing solution, and liquid. For example, the term "ink" also includes DNA sample, resist, pattern material, resin, and so on.

The term "image" used herein is not limited to a two-dimensional image and includes, for example, an image applied to a three-dimensional object and a three-dimensional object itself formed as a three-dimensionally molded image.

The present embodiment is described in detail using the embodiments. The embodiments described above are merely an example, and various modifications can be made within a range not deviating from the scope of the appended claims.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge apparatus, comprising:

a liquid discharge head to discharge liquid;

a head holder to hold the liquid discharge head;

a sub-carriage including a back side extending at least in a main scanning direction and holders at each end of the back side that extend at least in a sub-scanning direction to hold the head holder; and a carriage to hold the sub-carriage, movable in the main scanning direction and including a reference extending along the main scanning direction that holds and positions the back side of the sub-carriage in the carriage, the head holder including:

rotation references at each end of the head holder in the main scanning direction, the rotation references configured to rotate the head holder with respect to the holders of the sub-carriage, the head holder having an axis of rotation with the rotation references that is parallel with the main scanning direction; and angle adjusters at each end of the head holder in the main scanning direction and positioned forward from the rotation references in the sub-scanning direction, the angle adjusters configured to regulate and adjust an angle of the rotation of the head holder with respect to the holders of the sub-carriage.

2. The liquid discharge apparatus according to claim 1, further comprising shaft holes provided in one of the head holder and the sub-carriage, the rotation references rotatably supported within the shaft holes.

3. The liquid discharge apparatus according to claim 1, wherein each of the angle adjusters is a screw.

4. The liquid discharge apparatus according to claim 1, wherein each of the angle adjusters is a cam.

5. The liquid discharge apparatus according to claim 1, wherein each of the angle adjusters is a wedge.

6. The liquid discharge apparatus according to claim 1, further comprising an adjustment member rotatable around the sub-scanning direction perpendicular to the main scanning direction, wherein the sub-carriage is supported by the reference via the adjustment member, the adjustment member is supported by the sub-carriage, and a tilt of sub-carriage being adjustable with respect to the reference by rotation of the adjustment member around the sub-scanning direction.

7. The liquid discharge apparatus according to claim 1, further comprising an adjustment plate to adjust a position of the reference with respect to the carriage, wherein the reference is fixed to the carriage via the adjustment plate.

8. The liquid discharge apparatus according to claim 1, wherein the reference includes a cam that contacts the sub-carriage and positions the sub-carriage in a vertical direction.

* * * * *